United States Patent [19]

Mauffette

[11] Patent Number: 5,018,650

[45] Date of Patent: May 28, 1991

[54] TAMPER PROOF HANGER WITH INTERCHANGEABLE SHOULDER CUPS

[75] Inventor: Claude Mauffette, Montreal, Canada

[73] Assignee: Quada Internationale Ltd., Montreal, Canada

[21] Appl. No.: 485,521

[22] Filed: Feb. 27, 1990

[51] Int. Cl.[5] ..... A47G 25/30; A47G 25/28; A47G 25/14

[52] U.S. Cl. ..... 223/93; 223/88; 223/85; 223/91; 223/92

[58] Field of Search ..... 223/85, 88, 90, 92, 223/93, 89, 91, 94; 70/57, 59, 369, 370; 211/113

[56] References Cited

U.S. PATENT DOCUMENTS

| | | | |
|---|---|---|---|
| 2,490,590 | 12/1949 | Glavies | 223/88 |
| 2,628,748 | 2/1953 | Stratta | 223/88 |
| 3,008,615 | 11/1961 | Bury et al. | 223/93 |
| 3,237,820 | 3/1966 | Evans | 223/88 X |
| 4,324,352 | 4/1982 | Goldfarb | 223/91 |
| 4,615,447 | 10/1986 | Walter | 211/4 |
| 4,951,484 | 8/1990 | Rohald et al. | 70/59 |

FOREIGN PATENT DOCUMENTS

| | | | |
|---|---|---|---|
| 578068 | 10/1924 | France | 223/93 |
| 584994 | 12/1924 | France | 223/93 |
| 644526 | 6/1928 | France | 223/93 |
| 1203245 | 1/1960 | France | 223/89 |

*Primary Examiner*—Werner H. Schroeder
*Assistant Examiner*—Bibhu Mohanty
*Attorney, Agent, or Firm*—ROBIC

[57] ABSTRACT

There is disclosed an improved tamper-proof hanger having interchangeable shoulder cups. The tamper proof hanger is provided with gripping arms which move in the vertical plane of the hanger to clamp down on the hanger arms. The shoulder cups attach to the ends of the gripping arms, and a garment is secured to the hanger by clamping it between the shoulder cups and hanger arms. A locking mechanism locks the gripping arms in the clamping position and locks the hanger to a rod to prevent theft. The shoulder cups have a U-shaped cross-section and may slide onto the ends of the gripping arms using a tongue and groove arrangement. They are lined on their underside with an anti-slip material. This material preferably consists of a rubber pad having a central band extending away from the bottom of the cup to leave a gap in between. In this way, the band may conform to the size of the shoulders of the garment being secured, so that the garment is best gripped and secured.

11 Claims, 3 Drawing Sheets

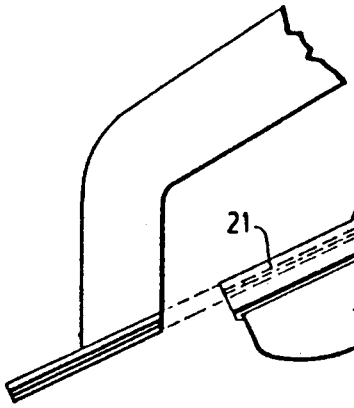
FIG. 3
FIG. 4
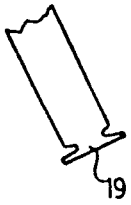
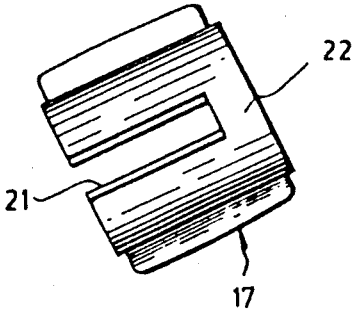
FIG. 5
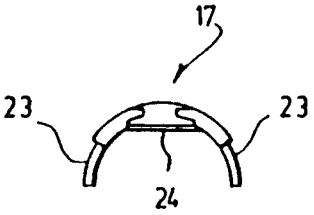
FIG. 6
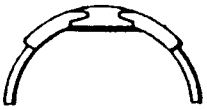
FIG. 7
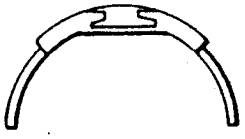
FIG. 8

TAMPER PROOF HANGER WITH INTERCHANGEABLE SHOULDER CUPS

FIELD OF THE INVENTION

The present invention relates to a tamper-proof hanger. More specifically, the invention relates to an improvement in the shoulder cups or pads used in tamper-proof hangers.

BACKGROUND OF THE INVENTION

Tamper-proof hangers are used to secure a hanger to a support or rack for clothing and to secure a garment to the hanger to prevent theft. A tamper-proof hanger is a hanger which has a gripping member to secure the garment hung on the hanger arms of the hanger. The gripping member normally has two gripping arms which move in the same plane as the gripping arms of the hanger. At the ends of the gripping arms, there is provided shoulder pads which clamp the garment between the ends of the gripping arms and the ends of the hanger arms "at the shoulders". A lock mechanism locks the gripping arms in the clamped position while simultaneously locking the hanger to the rack. The lock mechanism is released by a store clerk to remove the garment for a customer. An example of such a hanger is described in U.S. Pat. No. 4,324,352.

It has been found that the existing tamper-proof hangers can sometimes allow for the garment to be slipped off the hanger, since the gripping shoulder pads have only a limited grip on the garment.

SUMMARY OF THE INVENTION

The object of the present invention is to provide a tamper-proof hanger having an improved ability to grip any garment secured by the hanger.

The tamper-proof hanger according to the invention is of the kind used for securing a garment to the hanger and for securing the hanger to a support. The hanger comprises a hooking member for hooking the hanger onto the support. The hanger comprises a bow-shaped support member having two support arms and a central portion for supporting the garment, and a gripping member having two gripping arms and shoulder pads connected to each end of the two gripping arms for gripping the garment between the shoulder pads and the two support arms of the bow-shaped support member. The hanger comprises locking means for locking the gripping member in a position for securing the garment and for securing the hanger to the support. According to a first aspect of the invention, the above described hanger is improved in that the shoulder pads comprise shoulder cups which have an inverted U-shaped cross section and comprise an upper middle portion and two side portions. The upper middle portion is detachably engageable to the gripping arms, and the cup is adapted to fit over the garment on the support arms when the gripping arms are in the locked position. A rubber pad is mounted under the shoulder cups to improve gripping the garment. In this way, the shoulder cups may be interchanged to suit the size of the shoulders of the garment being secured, so that the garment is best gripped and secured.

According to another aspect of the invention, the above described hanger is also improved in that the shoulder pads comprise shoulder cups which have an inverted U-shaped cross section section and comprise an upper middle portion and two side portions. The cup is sized and adapted to fit over the garment on &he support arms when the gripping arms are in the locked position. A rubber pad is mounted under the shoulder cups to improve gripping the garment, each rubber pad being composed of two side walls fixed to the side portions of the corresponding cup and joined by a band, so that a gap is formed between the band and the upper middle portion. In this way, the band may conform to the size of the shoulders of the garment being secured, so that the garment is best gripped and secured.

BRIEF DESCRIPTION OF THE DRAWINGS

A preferred embodiment of the invention will now be described in greater detail with reference to the drawings, in which:

FIG. 3 is a side view the end of the gripping member and shoulder cup;

FIG. 4 is an end view of the gripping member;

FIG. 5 is a top view of the shoulder cup

FIGS. 6, 7 and 8 are end views of three different sizes of shoulder cups;

DETAILED DESCRIPTION OF THE PREFERRED EMBODIMENTS

Figure 1:
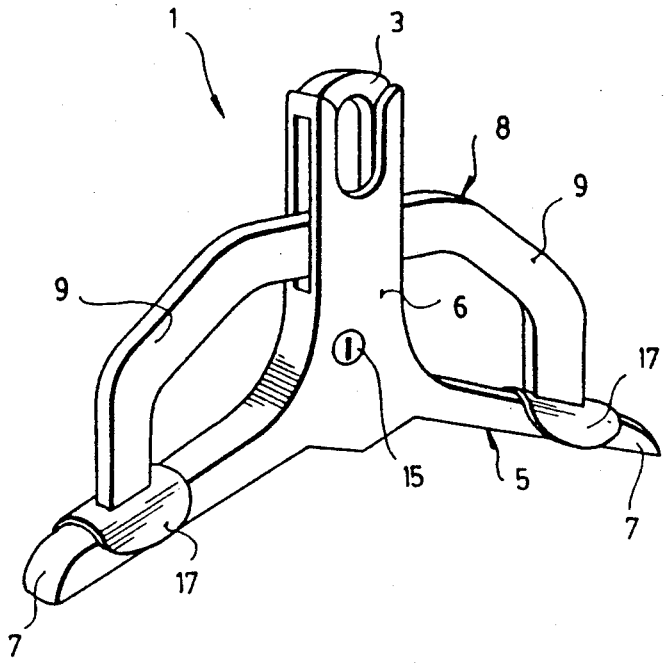
FIG. 1 is a perspective view of a tamper-proof hanger according to the invention.

In accordance with the invention, the hanger 1 shown in the accompanying drawings is improved both by interchangeable shoulder cups 17 as well as rubber pads 25 having central bands 27.

Hanger 1 has a standard hook or hooking member 3 to be hooked onto a horizontal rod of a clothes rack (not shown). Hook 3 is part of a gripping member 8 which also includes a central cross portion 10 and a pair of gripping arms 9. A ratchet member 11 is connected to portion 10. The integral assembly of elements 3, 10, 9 and 11 forming the member 8 moves vertically within the center portion 6 of a bow-shaped support member 5 comprising two support arms 7 extending from the center portion 6 like the arms of a standard hanger. A pawl 13 is mounted within the center portion 6 for engagement with ratchet member 11. A key lock 15 is used to release pawl 13 from member 11.

This basic structure is well known in the art (see U.S. Pat. No. 4,324,352) and need not be further described.

The operation of the hanger 1 is simple. A garment 2 (shown in FIGS. 10 and 11) is placed over support arms 7, hooking member 3 is placed on a rod of a rack, and center portion 6 is raised while pulling gripping arms 9 down onto the garment. Pawl 13 engages ratchet member 11 and holds arms 9 in position. A lip 12 of center portion 6 reaches the end of hook 3 and prevents hanger 1 from being removed from the rod of the rack. Shoulder cups 17 are contoured to grip the .garment 2 and keep it firmly on support arms 7. To release the garment 2, key lock 15 is used to release pawl 13, and portion 6 is lowered to allow the garment 2 to be released.

Figure 2:
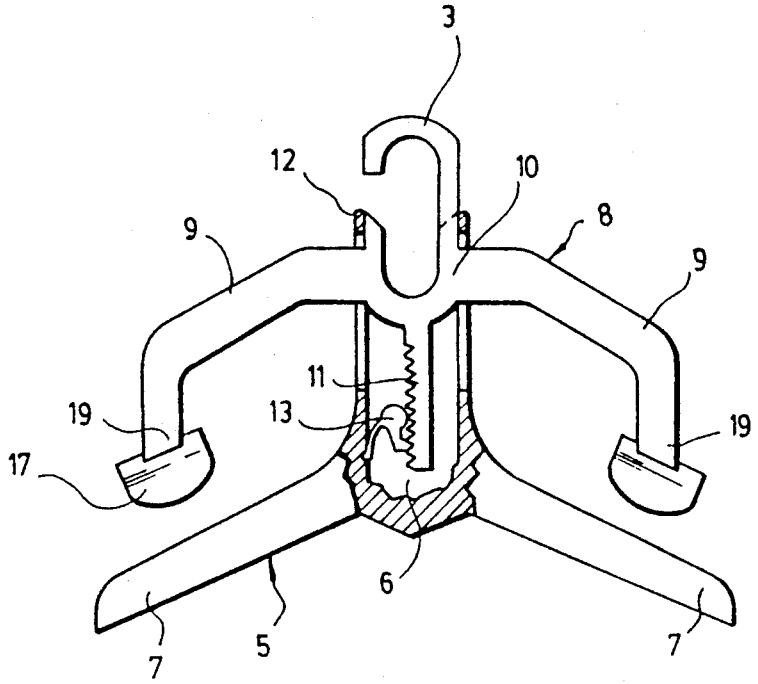
FIG. 2 is a break-away front view of the hanger of FIG. 1 in the open position.

The gripping arms 9 move in the same plane as the support arms 7. Although FIGS. 1 and 2 show the arms 9 moveable with central cross portion 10, it is possible to have arms 9 move in the same plane by pivoting from central cross portion 10 or center portion 6, as shown, by way of example, in FIG. 2 of U.S. Pat. No. 4,324,352.

In accordance with a first aspect of the invention, a shoulder cup 17 having a U-shaped cross-section is detachably mounted to the end 19 of each gripping arm 9 by means of slideable tongue and groove connection. As better shown in FIG. 4, the shoulder cup 17 has an upper middle portion 24 and side portions 23, and is made from an integral piece. Tongues and grooves 21 are provided in the upper surface of the middle portion 24 as shown in FIG. 3, to mate with opposite tongue and groove provided at end 19. These tongues and grooves having an axis of connection parallel to a lengthwise direction of said upper middle portion. A stop 22 stops the sliding when cup 17 is in position. FIGS. 3 through 8 show cup 17 without any rubber pad.

FIGS. 6 to 8 shows three different sizes of shoulder cups 17 which would be used for fitting over: a shirt a sweater or blazer and a leather coat respectively. By matching the shape of the garment 2 (see FIG. 10) with the right size of cup 17, an improved grip is obtained.

Figure 9:
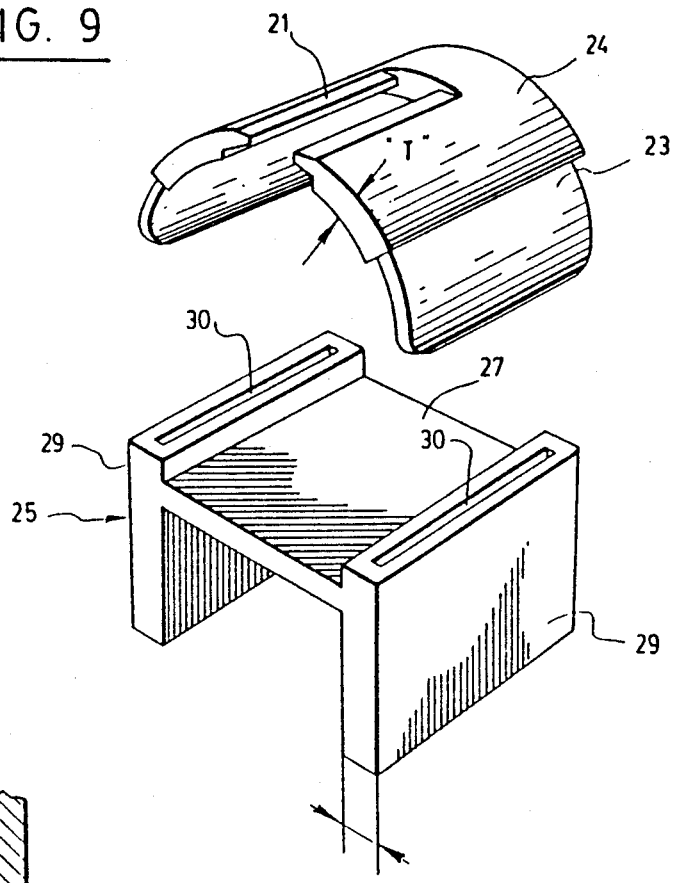
FIG. 9 is a perspective view of the shoulder cup and rubber pad.

In accordance with another aspect of the invention, shoulder cup 17 is provided with a rubber pad 25 before assembly (see FIG. 9). Before connection, the pad 25 has an H-shaped cross section and comprises two vertical side walls provided with slots 30 on that upper edges, and a horizontal band 27 joining the walls 29. The tab 25 is sized to allow the side portions 23 of the cups 17 which are shaped for this purpose into tabs, to fit snugly into slots in side walls 29 of pad 25. Band 27 which connects side walls 29 together, bulges downward when side walls 29 are bent to fit into the tab-forming side portions 23. Thus, a gap 31 is formed between upper middle portion 24 and band 27. The gap allows band 27 to yield while conforming to the shape of the garment 2. Preferably, the thickness "T" of upper middle portion 24 is the same as the one of the side walls 29 of the pad 25, so that the shoulder cup 17 fitted with pad 25 has an even appearance.

Figure 10:
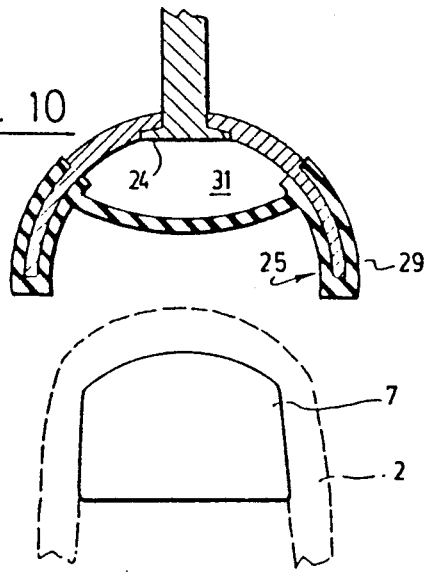
FIGS. 10 and 11 are end views of the shoulder cup with a rubber pad fitted thereon and with the band of this pad in the expanded and compressed positions respectively.
Figure 11:
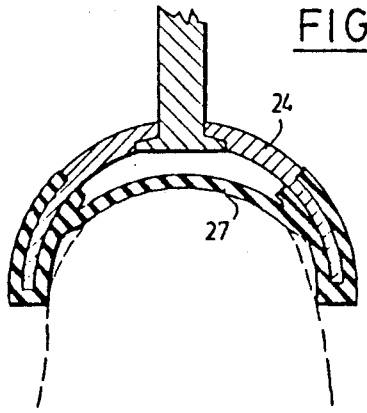

FIG. 10 shows band 27 before engagement, over the end of corresponding support arm 7 and FIG. 11 shows band 27 in engagement with the end of arm 7 and garment 2. The resilient band 27 conforms itself to the shape of the garment 2 without putting uneven pressure on the garment 2 which could cause marking or damage. There is still a small gap remaining between portion 24 and band 27.

Of course, any gap between band 27 and portion 24 serves the purpose of conforming to the shape of garment 2. It is preferred however that band 27 bulges downward to provide greater resiliency and ability to conform.

Similarly, other connection means than the tongue and groove connection 21 shown can be used to detacheably connect cups 17 to gripping arms 9.

As aforesaid, the interchangeable shoulder cups 17 and the rubber pads 25 having a band 27 providing a gap between the band 27 and the upper middle portion 24 are both features of the invention improving the grip of the shoulder cups 17 have on garment 2.

It is to be understood that the above description of the preferred embodiment is not to be limitative of the scope of the present invention as defined in the appended claims.

The embodiments of the invention in which an exclusive property or privilege is claimed are defined as follows:

1. A tamper-proof hanger for securing a garment to the hanger and for securing the hanger to a support, the hanger comprising:

a hooking member for hooking onto said support;

an arcuate support member for supporting said garment, said support member having two supporting arms and a central portion;

a gripping member having two gripping arms and shoulder pads connected to each end of the two gripping arms for gripping said garment between said shoulder pads and said two ends of said support arms; and locking means for locking said gripping arms in a locked position to secure said garment to said support arms and for locking said hooking member to said support;

the improvements wherein:

said should pads comprise shoulder cups, said shoulder cups having an inverted U-shaped cross section and comprising an upper middle portion and two side portions, said upper middle portion being detachably engageable to said gripping arms, said cups being sized and adapted to fit over said garment on said support arms when said gripping arms are in said locked position;

said cups are detachably engaged to said gripping arms by a tongue and groove connection, said tongue and groove connection being provided in said upper middle portion of said cups and at ends of said gripping arms, said tongue and groove connection having an axis of connection parallel to a lengthwise direction of said upper middle portion; and a rubber pad mounted under said shoulder cups to improve gripping of said garment, so that said shoulder cups may be interchanged and selected in size to grip and secure said garment.

2. The tamper-proof hanger defined in claim 1, wherein said rubber pad comprises two side walls joined by a band, and wherein each of the two side walls of said rubber pad are connected to each corresponding side portion of said cup, so that a gap between said band and upper middle portion is provided.

3. The tamper-proof hanger defined in claim 2, wherein said rubber pad is provided with slots on top of each of its side walls and wherein said side portions of said cups define tabs, said tabs being positioned and sized to fit into said slots so that said rubber pads can be easily connected to and removed from said cups.

4. The tamper-proof hanger defined in claim 3, wherein said band forms a bulge which projects away from said upper middle portion.

5. The tamper-proof hanger defined in claim 1, wherein said tongue and groove connection is provided with a stop to prevent said cups from further sliding along said axis.

6. A tamper-proof hanger for securing a garment to the hanger and for securing the hanger to a support, the hanger comprising:

a hooking member for hooking onto said support;

an arcuate support member for supporting said garment, said support member having two supporting arms and a central portion;

a gripping member having two gripping arms and shoulder pads connected to each end of the two gripping arms for gripping said garment between said shoulder pads and said two ends of said support arms; and locking means for locking said gripping arms in a locked position to secure said garment to said support arms and for locking said hooking member to said support;

the improvements wherein:

said shoulder pads comprise shoulder cups, said shoulder cups having an inverted U-shaped section and comprising an upper middle portion and two side portions, said cups being sized and adapted to fit over said garment on said support arms when said gripping arms are in said locked position; and a rubber pad is mounted under said should cups to improve gripping of said garment, said rubber pad comprising two side walls joined by a band, each of the two side walls of said rubber pad being connected to the corresponding side portion of said cup so that a gap between said band and upper middle portion is provided.

7. The tamper-proof hanger defined in claim 6, wherein said rubber pad is provided with slots on top of each of its side walls and wherein the side portions of said cups define tabs, said tabs being positioned and sized to fit into said slots so that said rubber pads be connected to and removed from said cups.

8. The tamper-proof hanger defined in claim 7, wherein said band forms a bulge which projects away from said upper middle portion.

9. The tamper-proof hanger defined in claim 6, wherein said upper middle portions of said cups are detachably engageable to said gripping arms.

10. The tamper-proof hanger defined in claim 9, wherein said cups are detachably engaged onto said gripping arms by a tongue and groove connection, said tongue and groove connection being provided in said upper middle portion of said cups and at ends of said gripping arms, said tongue and groove connection having an axis of connection parallel to an lengthwise direction of said upper middle portion.

11. The tamper-proof hanger defined in claim 10, wherein said tongue and groove connection is provided with a stop to prevent said cups from further sliding along said axis.

* * * * *